US006099899A

United States Patent [19]

Briggs et al.

[11] Patent Number: 6,099,899

[45] Date of Patent: Aug. 8, 2000

[54] METHOD FOR A MULTILAYER COATING

[75] Inventors: Rodney L. Briggs, Linden; Gregory G. Menovcik, Farmington Hills; Josef Rademacher, Beverly Hills; Cynthia A. Stants, Pinckney; Michele L. Stauffer, Ann Arbor, all of Mich.

[73] Assignee: BASF Corporation, Southfield, Mich.

[21] Appl. No.: 09/248,809

[22] Filed: Feb. 12, 1999

Related U.S. Application Data

[63] Continuation-in-part of application No. 08/859,870, May 21, 1997, abandoned.

[51] Int. Cl.[7] ..... B05D 1/38; B05D 5/06; B05D 7/26; B05D 3/02

[52] U.S. Cl. ..... 427/203; 427/195; 427/261; 427/379; 427/407.1; 427/410

[58] Field of Search ..... 427/409, 195, 427/203, 410, 407.1, 379, 142, 261, 264, 259

[56] References Cited

U.S. PATENT DOCUMENTS

| | | | |
|---|---|---|---|
| 3,639,147 | 2/1972 | Benefiel et al. | 427/389.7 |
| 3,893,727 | 7/1975 | Desilets | 427/412.1 |
| 3,911,178 | 10/1975 | McDowell et al. | 427/379 |
| 4,401,774 | 8/1983 | Kooymans et al. | 427/386 |
| 4,442,270 | 4/1984 | Passmore et al. | 525/440 |
| 4,491,611 | 1/1985 | Barnhoorn et al. | 427/387 |
| 4,801,680 | 1/1989 | Geary et al. | 528/272 |
| 4,804,581 | 2/1989 | Geary et al. | 428/332 |
| 4,988,767 | 1/1991 | Pettit, Jr. | 525/194 |
| 5,108,796 | 4/1992 | Yamanaka et al. | 427/379 |
| 5,175,227 | 12/1992 | Gardon et al. | 528/45 |
| 5,248,400 | 9/1993 | Franks et al. | 204/181.1 |
| 5,373,084 | 12/1994 | Chang | 528/272 |
| 5,376,457 | 12/1994 | Smith | 427/409 |
| 5,413,809 | 5/1995 | Hazan | 427/142 |
| 5,468,518 | 11/1995 | Lein et al. | 427/409 |
| 5,507,928 | 4/1996 | Bohmert et al. | 204/488 |
| 5,536,785 | 7/1996 | Foukes et al. | 525/176 |
| 5,573,812 | 11/1996 | Moy | 427/409 |
| 5,667,891 | 9/1997 | Batzar et al. | 427/205 |
| 5,716,679 | 2/1998 | Rockrath et al. | 427/379 |
| 5,766,767 | 6/1998 | Hisai et al. | 428/413 |
| 5,922,473 | 7/1999 | Muthiah et al. | 427/392 |
| 5,962,077 | 10/1999 | St. Clair | 427/407.1 |
| 6,011,080 | 1/2000 | Daly et al. | 522/107 |

*Primary Examiner*—Diana Dudash
*Attorney, Agent, or Firm*—Anne Gerry Sabourin

[57] ABSTRACT

A method for obtaining a cured multi-layer coating with good intercoat adhesion, comprising the steps of:

a) applying to a substrate a first powder coating composition comprising
   i) a polyester resin having a carboxyl functionality of less than two,
   ii) a crosslinker reactive toward the carboxyl groups of the polyester resin selected from the group consisting of epoxy-functional compounds,
   wherein the ratio of epoxy groups of the crosslinker to the carboxyl groups of the polyester is between 1.05:1 and 1.9:1, b) applying to the first coating layer at least one additional coating composition comprising a clearcoat including
   i) a hydroxyl functional acrylic resin and
   ii) a crosslinker reactive toward the hydroxyl groups on the acrylic resin, c) curing the coating compositions together or sequentially.

12 Claims, No Drawings

METHOD FOR A MULTILAYER COATING

This application is a continuation-in-part of U.S. application Ser. No. 08/859,870 filed on May 21, 1997, now abandoned.

FIELD OF THE INVENTION

The invention relates to a method for a multilayer coating providing intercoat adhesion between a powder primer coating layer and a clearcoat layer.

BACKGROUND OF THE INVENTION

A multilayer coating provides a decorative or a protective coating on a substrate. The multilayer coating on a substrate employs at least two coating layers which may be any combination of electrocoat, primer, filler, pigmented basecoat, and clearcoat coating layers. The multilayer coating may be obtained by first applying a powder primer to a bare or electrocoated substrate. Over the primer layer, other coatings such as the basecoat and clearcoat may be applied. In some instances, a basecoat is applied over the primer and then a clearcoat layer of a coating is applied over the basecoat. Where a two color coating is desired, different approaches may be taken. In one approach, one color basecoat may be applied to part of a primer-coated substrate, then a clearcoat is applied to the entire substrate, followed by application of a different color basecoat to the remainder of the substrate, and finally a clearcoat layer being applied over all. Alternatively, one primer-coated area may be painted with basecoat, followed by application of the clearcoat, and curing of both layers together or sequentially. The area is then covered to protect it from a second color. Subsequently, a second primer-coated area is coated with a different color basecoat, then coated with clearcoat, and the layers are cured together or sequentially.

It is highly desirable to provide a multilayer coating system which promotes intercoat adhesion. The present invention is directed to a method for forming a multilayer coating promoting intercoat adhesion. The present invention is further directed to a method for forming a multilayer coating, promoting intercoat adhesion between a primer layer and a clearcoat layer in direct contact with each other.

SUMMARY OF THE INVENTION

A method for obtaining a cured multi-layer coating which promotes intercoat adhesion, comprising the steps of:

a) applying to a substrate a first powder coating composition comprising
   i) a polyester resin having a carboxyl functionality of less than two, and
   ii) a crosslinker reactive toward the carboxyl groups of the polyester resin selected from the group consisting of epoxy-functional compounds,
   wherein the ratio of epoxy groups of the crosslinker to the carboxyl groups of the polyester is between 1.05:1 and 1.9:1,
b) applying to the first coating layer at least one additional coating composition comprising a clearcoat including
   i) a hydroxyl functional acrylic resin and
   ii) a crosslinker reactive toward the hydroxyl groups on the acrylic resin, and
c) curing the coating compositions simultaneously or sequentially.

DETAILED DESCRIPTION OF THE INVENTION

The present invention provides a method for forming a multilayer coating which promotes intercoat adhesion. The method is particularly useful in a multilayer coating utilizing a powder primer comprising a polyester resin and an epoxy functional crosslinking agent and a clearcoat composition comprising a hydroxy functional acrylic resin and a crosslinking agent reactive with the hydroxy functionality. The invention is useful for promoting intercoat adhesion between the primer and basecoat or the primer and clearcoat layers that directly contact each other.

The polyester resin of the invention has a carboxyl functionality of less than two. It is undesirable that the polyester have a carboxyl functionality of greater than 2, as coatings containing such polyesters demonstrate less desirable appearance and adhesion. Such polyester resins are obtained by a condensation reaction between a polyol component and a poly-functional acid component or its anhydride. Excess poly-functional acid is used so that an acid-functional polyester is formed. Preferably, the polyester resin has an acid number of 30 to 38 mg KOH/g. The polyester resin also preferably has a Tg of 50 to 60° C. The viscosity of the polyester, as measured at 200° C., is preferably from 4500 to 5500 mPas.

The poly-functional acid or anhydride compound used to form the polyester may be alkyl, alkylene, aralkylene, or aromatic compounds. Dicarboxylic acids and anhydrides are preferred. However, acids or anhydrides with higher functionality may also be used. If tri-functional compounds or compounds of higher functionality are used, these may be used in mixture with mono-functional carboxylic acids or anhydrides of monocarboxylic acids, such as versatic acid, fatty acids, or neodecanoic acid.

Illustrative examples of acid or anhydride functional compounds suitable for forming the polyester groups or anhydrides of such compounds include phthalic acid, phthalic anhydride, isophthalic acid, terephthalic acid, hexahydrophthalic acid, tetrachlorophthalic anhydride, hexahydrophthalic anhydride, pyromellitic anhydride, succinic acid, azeleic acid, adipic acid, 1,4-cyclohexanedicarboxylic acid, citric acid, and trimellitic anhydride.

The polyol component used to make the polyester resin also has a hydroxyl functionality of at least 2.0. The polyol component may contain mono-, di-, and tri-functional alcohols, as well as alcohols of higher functionality. Diols are preferred as the polyol component. Alcohols with higher functionality may be used where some branching of the polyester is desired, and mixtures of diols and triols are also preferred as the polyol component. Highly branched polyesters are not desired due to undesirable effects on the coating, such as decreased flow and undesirable effects on the cured film, such as diminished chip resistance and smoothness.

Examples of useful polyols are ethylene glycol, diethylene glycol, triethylene glycol, propylene glycol, dipropylene glycol, butylene glycol, glycerine, trimethylolpropane, trimethylolethane, pentaerythritol, neopentyl glycol, 2,2,4-trimethyl-1,3-pentanediol, 1,6-hexanediol, 1,4-cyclohexane dimethanol, hydrogenated bisphenol A, and hydoxyalkylated bisphenols.

The methods of making polyester resins are well-known. Polyesters are typically formed by heating together the polyol and poly-functional acid components, with or without catalysis, while removing the by-product of water in order to drive the reaction to completion. A small amount of a solvent, such as toluene, may be added in order to remove the water azeotropically. If added, such solvent is preferably removed from the polyester product before powder coating formulation is begun.

Many polyester resins are commercially available as 100% solid materials that can be used in powder coating compositions, such as those sold by Hoechst, Portsmouth, Va. 23704, under the tradename Alftalat; by EMS-American Grilon, Inc., Sumter, S.C. 29151, under the tradename Grilesta; and by CIBA-Geigy Corporation, Ardsley, N.Y. 10502, under the tradename Arakote.

The thermosetting powder coating composition of the invention further includes a crosslinker that is reactive toward the carboxyl groups of the polyester resin. Examples of materials suitable as the crosslinker include epoxy-functional compounds, such as epoxy-functional epoxy resins, epoxy-functional acrylic resins, and triglycidyl isocyanurate; polyoxazolines; and polydioxanes.

Examples of epoxy-functional epoxy resins include bisphenol A-type epoxy resins, novolac epoxy resins, and alicyclic epoxy resins. Epoxy resins based on bisphenol A are preferred. The epoxy resins preferably have epoxy equivalent weights between 500 and 2000, and more preferably between 600 and 1000. The polyepoxide may be saturated or unsaturated, aliphatic, cycloaliphatic, aromatione or heterocyclic. Examples of suitable polyhydric alcohols include 2,2-bis(4-hydroxyphenyl)propane (BisphenolA); 2,2-bis(4-hydroxy-tert butylphenyl)propane; 1,1-bis(4-hydroxyphenyl)ethane; 1,1-bis(4-hydroxyphenyl) isobutane; 2,2-bis(4-hydroxytertiarybutylphenyl)propane; bis(2-hydroxynapthyl)methane; 1,5-dihydroxynaphththalene; 1,1-bis(4-hydroxy-3-alkylphenyl) ethane and the like.

Solid epoxy resins suitable for use in powder coatings are readily available commercially, such as bisphenol A, for example, from Dow Chemical Co., Midland, Mich. 48674, under the tradename D.E.R.; Araldite, from CIBA-Geigy Corp., Ardsley, N.Y., 10502 from Shell Chemicals, Yardley, Pa. under the tradename Epon.

It is critical to the invention that the polyester-epoxy coating composition have a ratio of epoxy to carboxy of greater than one, to provide the intercoat adhesion provided by the present invention. The intercoat adhesion provided between the powder layer and additional coating layers improved greatly where the ratio of epoxy to carboxy functionality was greater than an approximately stoichiometric ratio of 1:1, where a variation of ±2% is considered within stoichiometric proportions. The preferred ratio of carboxy to epoxy functionality in the primer coating composition is 1.0:1.05 to 1.0:1.9, and more preferably between 1.15:1 and 1.7:1. Most preferably, the ratio of epoxy to carboxy functionality is between s 1.4:1 to 1.6:1. It is hypothesized that the excess epoxy functionality is available to react with the reactive functionality of additional coating layers, where such reactive functionality may be hydroxyl, phenol, amino, carboxyl, epoxy or mercaptan. The excess epoxy also improves rheology of the coating composition and may serve to scavenge excess amines from an electrocoating composition, that may migrate to the surface of a cured coating and deleteriously effect the long term durability of the coating.

Clearcoat coating compositions according to the present invention may comprise a polyurethane or acrylic based coating cured with melamine or isocyanate. Preferably the clearcoat includes a reactive functionality such as hydroxyl, phenol, amino, carboxyl, epoxy or mercaptan. Most preferably, the clearcoat comprises an acrylic resin having hydroxyl functionality. The acrylic resin has a weight average molecular weight of between about 4000–6000, preferably about 4000, a hydroxy equivalent weight of between about 280–350, preferably about 310–330. The crosslinking agent for the clearcoat is selected from the group consisting of melamine, blocked isocyanate and unblocked isocyanate crosslinkers and mixtures thereof. Preferably, the clearcoat composition comprises a mixture of alkylated melamine and a blocked isocyanate crosslinker. The clearcoat may be waterborne, solvent borne or powder. Preferably the clearcoat is solvent borne. The solvent is present in an amount between 30 and 60%, preferably 40–50% by weight. The clearcoat may comprise additional components such as ultraviolet light absorbers, hindered amine light stabilizers, surfactants, stabilizers, fillers, wetting agents, rheology control agents, dispersing agents and adhesion promoters. While the agents are well known in the prior art, the amount used must be controlled to avoid adversely affecting the coating characteristics.

Pigmented basecoat compositions useful for purposes of the present invention include any of a number of types well known in the art, and do not require explanation in detail. Polymers known in the art to be useful in basecoat compositions include acrylics, vinyls, polyurethanes, polycarbonates, polyesters, alkyds and polysiloxanes. Preferred polymers include acrylics, vinyls, polyurethanes, polycarbonates, polyesters, alkyds, and polysiloxanes. Preferred polymers include acrylics and polyurethanes. Basecoat polymers may be thermoplastic, but are preferably crosslinkable and comprise one or more type of crosslinkable functional groups. Such groups include for example, hydroxy, isocyanate, amine, epoxy, acrylate, vinyl, silane, and acetoacetate groups. These groups may be masked or blocked in such a way so that they are unblocked and available for a crosslinking reaction under the desired curing conditions, generally elevated temperatures. Useful crosslinkable functional groups include hydroxy, epoxy, acid, anhydride, silane, and acetoacetate groups. Preferred crosslinkable functional groups include hydroxyl functional groups and amino functional groups.

Basecoat polymers may be self-crosslinkable, or may require a separate cross-linking agent that is reactive with the functional groups of the polymer. When the polymer comprises hydroxy functional groups, for example, the cross-linking agent may be an aminoplast resin, isocyanate crosslinker, blocked isocyanate crosslinker, acid or anhydride cross-linking agent. The basecoat is preferably pigmented and may include organic or inorganic compounds or colored materials, fillers, metallic or other inorganic flake materials such as mica or aluminum flake, and other materials that the art normally names as pigments. Pigments are usually used in the composition in an amount of 1% to 100% based on the total solid weight of components in the coating composition (i.e. a pigment to binder ratio of 0.1 to 1.0.

The coating compositions are subject to conditions so as to cure the coating layers. Although various methods may be used, heat-curing is preferred. Generally, heat curing is effected by exposing the coated article to elevated temperatures provided primarily by radiative heat sources. Curing temperatures will vary depending on the particular blocking groups used in the crosslinking agents, however they generally range between 285° F. (140.5° C.) and 385° F. (196.1° C.). The curing time will vary depending on the particular components used, and physical parameters such as the thickness of the layers, however typical curing times range between 15 to 60 minutes. The various coating layers may be cured simultaneously or sequentially. Preferably, the primer layer is applied first and cured. The bake window for the powder primers according to the present invention is between 320° F. (160° C.) and 375° F. (190.5° C.) for between 5 and 60 minutes. Preferably, the clearcoat and basecoat are applied to the primer layer and cured together. A two tone coating may be obtained by applying basecoat over a portion of a primed substrate, followed by application of clearcoat over the entire substrate and simultaneous curing. The part of the substrate not basecoated is then coated with a second color basecoat and the entire substrate is then coated with clearcoat and the coatings are then cured simultaneously.

The method of the present invention provides an expanded bake window for the primer coating used in the multilayer coating. The bake window refers to the time and temperature required to achieve 85–90% cure of the powder primer. Cure refers to reaction of the carboxy functional groups on the polyester with epoxy functional groups on the epoxy resin to form β-hydroxy ether linkages. It is desirable that the primer not be 100% cured, so that epoxy groups remain available to react with functionality on the clearcoat of the multilayer coating. The reaction between functional groups on the primer and clearcoat provides better intercoat adhesion, because there is a chemical bond between the coatings. The bake window is determined in part by the ratio of epoxy groups to carboxyl groups in the powder primer. For example, for the control coating composition the ratio is 0.98, and the coating is 85–90% cured at a bake time of 20 minutes at 335° F. (168.3° C.). The bake window for the control primer coating is at temperatures between 315° F. (157.2° C.) and 335° F. (168.3° C.) for between 10 and 60 minutes. Generally, the intercoat adhesion failure results due to longer bake times at higher temperatures.

The present invention is illustrated by the following non-limiting examples.

EXAMPLES

Example 1

Powder Primer Coating Formulation

| Ingredient | Amount (% by Weight) | | | | |
|---|---|---|---|---|---|
| | Control | Test 1 | Test 2 | Test 3 | Test 4 |
| Alftalat AN783[1] | 35.70 | 35.05 | 34.35 | 33.95 | 33.35 |
| Araldite GT 7013[2] | 18.50 | 19.30 | 20.00 | 20.50 | 21.10 |
| Johnson Acrylic Resin SCX 819[3] | 3.95 | 3.80 | 3.80 | 3.70 | 3.70 |
| Uraflow B[4] | 0.40 | 0.40 | 0.40 | 0.40 | 0.40 |
| Lancowax[5] | 0.20 | 0.20 | 0.20 | 0.20 | 0.20 |
| Nonionic Surfactant[6] | 1.0 | 1.0 | 1.0 | 1.0 | 1.0 |
| Trimethylolpropane | 0.25 | 0.25 | 0.25 | 0.25 | 0.25 |
| Titanium dioxide | 20.30 | 20.30 | 20.30 | 20.30 | 20.30 |
| Black pigment[7] | 0.10 | 0.10 | 0.10 | 0.10 | 0.10 |
| Aerosil[8] | 0.20 | 0.20 | 0.20 | 0.20 | 0.20 |
| Extender[9] | 19.40 | 19.40 | 19.40 | 19.40 | 19.40 |
| Epoxy/Carboxy Ratio | 0.98 | 1.05 | 1.10 | 1.15 | 1.20 |

[1]Carboxy functional polyester, available from Hoechst, 810 Water St., Portsmouth Virginia 23704.
[2]Bisphenol AEpoxy, available from Ciba Geigy Corp., Ardsley, New York 10502.
[3]Acrylic resin, available from S. C. Johnson and Son, Racine, Wisconsin 53403
[4]Available from GCA Chemical, Bradenton, Florida 34205
[5]Available from Cray Valley Products, Stuyvesant, NY 12173
[6]BASF Lutanol Surfactant, available from BASF Corporation, Wyandotte, Michigan.
[7]Available from Degussa, Rt. 46, Teterboro, New Jersey 07608
[8]Available from Degussa, Rt. 46, Teterboro, New Jersey 07608
[9]Available from Cyprus Foote Mineral Co., Malvern, Pennsylvania as Barimite XF.

Example 2

Clearcoat Formulation

| Ingredient | Amount (% by weight) |
|---|---|
| Isobutyl Alcohol | 13.36 |
| Exxate 600 Solvent[1] | 14.54 |
| Blocked Isophorone diisocyanate[2] | 9.16 |
| Hydroxy Functional Acrylic Resin[3] | 8.35 |
| Melamine Crosslinker[4] | 9.74 |
| Ultraviolet Absorber[5] | 8.74 |
| Dislon Flow Additive[6] | 7.4 |
| Byk Flow Additive[7] | 7.08 |
| Amyl Acetate Solvent | 14.66 |

[1]Available from Ashland Chemical.
[2]Available from Bayer Corporation, under the tradename Desmodur BL XP-7098E
[3]Available from BASF Corporation as 342CD0653
[4]Available from American Cyanamid under the tradename Cymel 327
[5]Available from Ciba Additives under the tradename Tinuvin 123
[6]Available from King Industries under the tradename Dislon L-1984
[7]Available from Byk Chemie under the tradename Byk VP-320.

Example 3

Results for Humidity and Gravelometer Testing

Electrocoated panels were powder primer coated at a feathered thickness of 1 to 5 mils, and baked at 340° F. for 20 minutes. Clearcoat was applied at a thickness of about 1.8 mils, followed by curing at 280° F., for 20 min. The basecoat was applied at a thickness of about 0.7 mils, with a flash of 5 minutes at 150° F., followed by curing at 280° F. for 20 min.

Initial Adhesion, was conducted according to test method D 3359 (x scribe and tape pull), high bake humidity adhesion testing was conducted according to ASTM B117 without salt. Score of 10 indicates no removal of paint, 0 indicates total removal of paint. Freezer Gravel tests were conducted at 45° and 90° according to test method SAE J400. Results are set forth in Table 1.

TABLE 1

Comparison of Data
The following data is set forth for test samples as described above.

| Example | Initial Adhesion | 3 Day Humidity Adhesion | Freezer Gravel Test at 45° Adhesion | Freezer Gravel Test at 90° Adhesion |
|---|---|---|---|---|
| Control | 4 | 1.0 | 5.0 | 6.0 |
| Test 1 | 4.5 | 1.5 | 5.0 | 6.0 |
| Test 2 | 4.8 | 3.0 | 7.0 | 8.0 |
| Test 3 | 8.0 | 7.0 | 7.0 | 8.0 |
| Test 4 | 9.0 | 8.0 | 10.0 | 10.0 |
| Test 5 | 10.0 | 10.0 | 10.0 | 10.0 |
| Test 6 | 10.0 | 10.0 | 10.0 | 10.0 |

We claim:

1. A method for obtaining a cured multi-layer coating providing intercoat adhesion, comprising the steps of:

a) applying to a substrate a powder coating primer composition comprising i) a polyester resin having a carboxyl functionality of less than two, ii) an epoxy functional compound, reactable with the carboxyl functionality of (i), wherein the ratio of epoxy groups to carboxyl groups is between 1.05:1 and 1.9:1, b) curing the powder coating;

c) subsequently applying directly to all or part of the powder coating layer at least one additional coating composition comprising i) a resin having reactive functionality selected from the group consisting of hydroxyl, phenol, amino, carboxyl, epoxy or mercaptan functionality and ii) a crosslinking resin reactive toward the reactive functionality of component (c)(i), d) curing the additional coating composition(s).

2. A method according to claim 1 wherein the powder coating comprises a ratio of epoxy functionality to carboxyl functionality of between 1.15:1 and 1.5:1.

3. A method according to claim 1 wherein the powder coating comprises a ratio of epoxy functionality to carboxyl functionality of between 1.4:1 and 1.6:1.

4. A method according to claim 1 wherein the additional coating composition is a clearcoat composition comprising hydroxy functional acrylic resin and crosslinker selected from the group consisting of aminoplast, blocked isocyanate and unblocked isocyanate crosslinkers and mixtures thereof.

5. A method according to claim 4 wherein the clearcoat composition comprises a mixture of melamine aminoplast crosslinker and a blocked isocyanate crosslinker.

6. A method according to claim 4 further comprising application of one or more basecoat compositions over the clearcoat layer.

7. A method according to claim 1 further comprising application of a basecoat composition over a portion of the primer layer on the substrate, leaving a portion of the primer layer without basecoat, followed by application of clearcoat over both the basecoated layer and the primer layer without basecoat.

8. A method according to claim 7 further comprising application of a second basecoat of a different color over the layers of primer and clearcoat to provide a two tone color effect.

9. A method for forming a multilayer coating providing intercoat adhesion comprising the steps of:

a) applying to a substrate a powder primer coating composition at a thickness between 1 and 5 mils, comprising i) a polyester resin having a carboxyl functionality of less than two, ii) an epoxy functional crosslinker reactive toward the carboxyl groups of the polyester, wherein the ratio of epoxy to carboxyl functionality is between 1.05:1 and 1.9:1, b) curing the primer coating at a temperature between 320° F. (160° C.) and 375° F. (190.5° C.) for between 5 and 60 minutes, c) applying to the first coating layer at a basecoat coating layer and a clearcoat coating layer, wherein the clearcoat includes i) a hydroxyl functional acrylic resin and ii) a crosslinker selected from the group consisting of aminoplast, unblocked isocyanate, blocked isocyanate and reactive toward the hydroxyl groups on the acrylic resin, d) curing the basecoat and clearcoat compositions sequentially at a temperature between 260° F. (126.6° C.) to 310° F. (154.4° C.) for 10–25 minutes.

10. A method according to claim 9 wherein the intercoat adhesion between a primer having a ratio of epoxy functionality to carboxy functionality of at least 1.15:1 demonstrates 100% increase in initial adhesion tests conducted according to ASTM test method D3359, in comparision to a primer coating containing epoxy and carboxy functionality in a stoichiometric ratio, where both primers are applied over identical clearcoats and basecoats and baked under identical conditions.

11. A method according to claim 9 further comprising the step of applying basecoat over the primer coating on part of the substrate, followed by application of clearcoat over the entire substrate, wherein a portion of the coated substrate comprises a primer layer and a clearcoat layer with no basecoat.

12. A method according to claim 11 wherein basecoat of a different color is applied over the primer and clearcoat layers in the area with no basecoat to provide a two tone color effect.

* * * * *